US006978917B2

(12) United States Patent
Giustini et al.

(10) Patent No.: US 6,978,917 B2
(45) Date of Patent: Dec. 27, 2005

(54) GARMENT HANGER WITH IMPROVED TAB HOLDER

(75) Inventors: Robert R. Giustini, Terrebonne (CA); Koen De Winter, Montréal (CA)

(73) Assignee: Terpac Plastics Inc., Montréal (CA)

( * ) Notice: Subject to any disclaimer, the term of this patent is extended or adjusted under 35 U.S.C. 154(b) by 0 days.

(21) Appl. No.: 10/391,497

(22) Filed: Mar. 18, 2003

(65) Prior Publication Data

US 2003/0178451 A1 Sep. 25, 2003

Related U.S. Application Data

(63) Continuation-in-part of application No. 10/247,908, filed on Sep. 20, 2002, now abandoned, which is a continuation-in-part of application No. 09/691,709, filed on Oct. 18, 2000, now abandoned.

(51) Int. Cl.[7] ..... A41D 27/22
(52) U.S. Cl. ..... 223/85
(58) Field of Search ..... 223/85; 40/322

(56) References Cited

U.S. PATENT DOCUMENTS

| | | | | | |
|---|---|---|---|---|---|
| 4,115,940 | A | | 9/1978 | Phillips | 40/322 |
| 5,096,101 | A | | 3/1992 | Norman et al. | 223/85 |
| 5,199,608 | A | | 4/1993 | Zuckerman | 223/85 |
| 5,238,159 | A | | 8/1993 | Zuckerman | 223/85 |
| 5,305,933 | A | * | 4/1994 | Zuckerman | 223/85 |
| 5,485,943 | A | | 1/1996 | Zuckerman | 223/85 |
| 5,611,469 | A | | 3/1997 | Eiley et al. | 223/85 |
| 5,687,887 | A | * | 11/1997 | Bond et al. | 223/85 |
| 5,913,462 | A | * | 6/1999 | Petrou | 40/322 |
| 5,950,883 | A | * | 9/1999 | Bond et al. | 40/322 |
| 6,189,746 | B1 | * | 2/2001 | Gouldson | 223/85 |
| 6,260,745 | B1 | * | 7/2001 | Gouldson et al. | 40/322 |

FOREIGN PATENT DOCUMENTS

| | | | | |
|---|---|---|---|---|
| CA | 1316155 | | 4/1993 | A47G 25/48 |
| CA | 2148171 | | 10/1996 | A47G 25/14 |
| WO | WO 98/03103 | * | 2/1998 | A47G 25/14 |

* cited by examiner

*Primary Examiner*—Gary L. Welch
(74) *Attorney, Agent, or Firm*—Collard & Roe, P.C.

(57) ABSTRACT

The present invention relates a garment hanger adapted to receive a removable information tab. Such a garment hanger has a body, a hook member connected to the body, a tab holder operatively connected to said hanger. The tab holder has two opposites surfaces, each of said opposite surfaces have an edge, and first, second and third engagement elements. The engagement elements are parallel to one another and are disposed perpendicular to the edge. Furthermore, each of the engagement elements have first, second and third projecting members. The first projecting member is adjacent to the edge of the opposite surface. Each of the engagement elements further have a first valley defined between the first and second projecting elements, and a second valley defined between the second and third projecting element. Finally, each of the engagement elements have a first groove that is defined between the first and third engagement elements and a second groove that is defined between the second and third engagement elements. Such a garment hanger facilitates the installation of an information tab thereon yet being secure against accidental disengagement.

14 Claims, 5 Drawing Sheets

GARMENT HANGER WITH IMPROVED TAB HOLDER

CROSS-REFERENCE TO RELATED APPLICATIONS

This application is a Continuation-in-Part (CIP) application of U.S. Ser. No. 10/247,908 filed Sep. 20, 2002 now abandoned, which is a continuation of U.S. Ser. No. 09/691,709 filed Oct. 18, 2000 now abandoned.

FIELD OF THE INVENTION

The present invention broadly relates to garment hangers. More specifically, the invention relates to a tab holder for a garment hanger.

BACKGROUND OF THE INVENTION

It is desirable to provide a plastic garment hanger that can show information about the merchandise on display. Several types of garment hangers having an information tab on the base of the hook connecting it to the body of the hanger, are known. For instance, they are often used for displaying children clothes. The information tab used on each of these hangers are often times irremovable. For the ones that are removable, they are usually adapted to be used specifically with one type of hanger.

U.S. Pat. No. 5,611,469 is concerned with an identification clip adapted to be secured on a garment hanger. The identification clip according to the invention is not manually removable. Furthermore, it is made to fit the clip holder of the garment.

U.S. Pat. No. 5,199,608 is concerned with an identification tab that is irremovably secured to a garment hanger. The purpose of providing such tab is to prevent accidental removal of the tab from the garment hanger, once it is mounted on the latter by a store clerk.

U.S. Pat. No. 4,115,940 is concerned with a removable and changeable tab for a garment hanger. The tab is simple in structure in that it is moulded in one piece. However, it does not seem to be designed to fit a wide range of tab holders.

SUMMARY OF THE INVENTION

It is an object of the present invention to provide an improved garment hanger.

It is a further object of the invention to provide a garment hanger that facilitates the installation of an information tab thereon yet being secure against accidental disengagement.

More specifically, in accordance with the present invention, these objects are achieved with a garment hanger that is adapted to receive a removable information tab. The garment hanger comprises a body, a hook member connected to the body, and a tab holder operatively connected to the hanger. The tab holder comprises two opposites surfaces, each of the opposite surfaces have an edge, and first and second engagement elements. The engagement elements are substantially parallel to one another and are disposed substantially perpendicular to the edge. The engagement elements are further shaped and sized to cooperatively engage with an information tab. Each of the opposite surfaces further have a first groove that is defined between the first and second engagement elements.

According to another object of the invention, it is provided a garment hanger adapted to receive a removable information tab. Such a garment hanger comprises a body, a hook member connected to said body, a tab holder operatively connected to said hanger. The tab holder comprises two opposites surfaces, each of said opposite surfaces have an edge, and first, second and third engagement elements. The engagement elements are substantially parallel to one another and are disposed substantially perpendicular to the edge. Furthermore, each of the engagement elements comprises first, second and third projecting members. The first projecting member is adjacent to the edge of the opposite surface. Each of the engagement elements further comprises a first valley defined between the first and second projecting elements, and a second valley defined between the second and third projecting element. Finally, each of the engagement elements comprises a first groove that is defined between the first and third engagement elements and a second groove that is defined between the second and third engagement elements.

Furthermore, another object of the invention is to provide a garment hanger as defined above with a universal information tab.

An advantage provided by the garment hanger of the invention is that its configuration makes it difficult to remove the tab mounted thereon, and especially against a child.

DETAILED DESCRIPTION OF THE INVENTION

Figure 1:
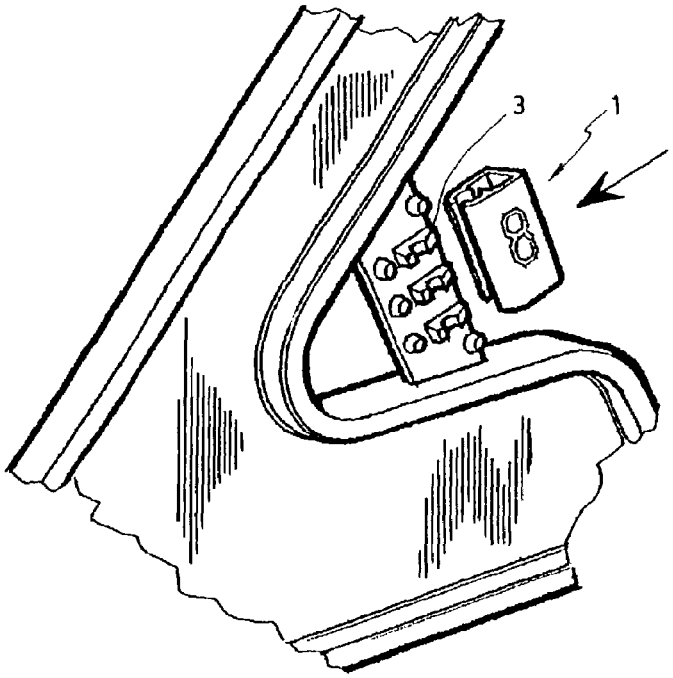
FIG. 1 is a perspective side view of the information tab according to a preferred embodiment of the present invention, that is ready to be slid in a corresponding portion of the hanger.

As can be seen in FIG. 1, the universal tab 1 of the present invention is adapted to be secured on a tab holder 3 on a garment hanger. The information tab 1 is clipped on the tab holder 3 in a conventional manner.

Figure 2:
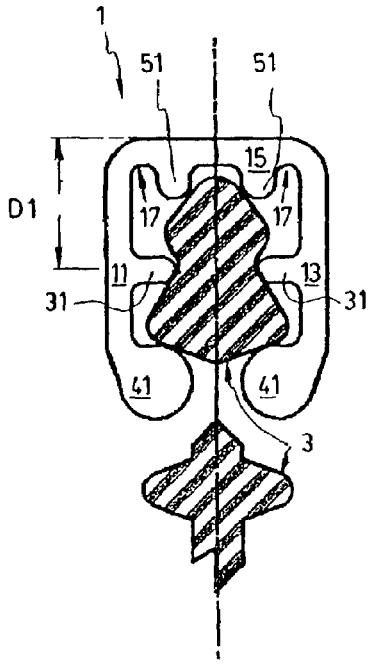
FIGS. 2 to 4 are a cross sectional views of the information tab of FIG. 1 mounted on different prior art tab holders.
Figure 3:
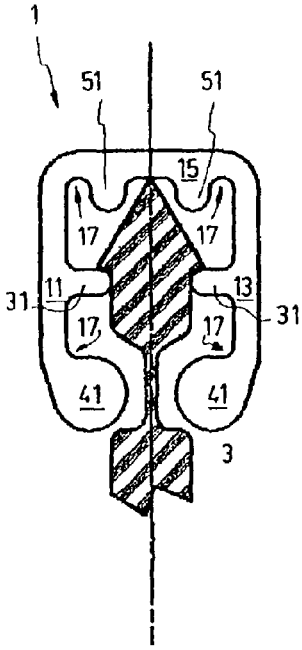
Figure 4:
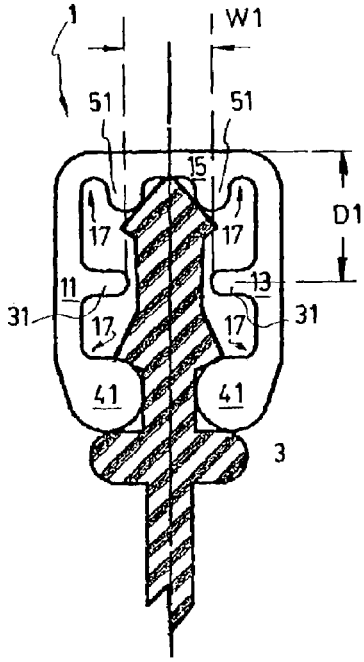

Referring now to FIGS. 2 to 4, the information tab 1 comprises a U-shaped bracket which includes two legs 11,13 extending substantially parallel to each other. The two legs 11,13 are connected at one end to a bridge 15 which extend perpendicularly with respect to the legs. The U-shaped bracket defines an inner surface 17 which is adapted to be removably secured on the tab holder 3 of the garment hanger.

The inner surface 17 of the information tab 1 of the invention comprises an integrally formed flange 31 projecting perpendicularly inwardly from each leg. The flange 31 is formed at a distance D1 from the first end of the leg. The distance D1 corresponds to a predetermined point along the leg. Preferably, D1 is calculated to be approximately at the middle point of each leg. Each flange is located on the leg so that they face each other and are separated by an open space having a width W1 between the facing extremities of each flange.

As further shown in FIGS. 2 to 4, the inner surface 17 of the universal information tab 1 of the invention also comprises an integrally formed gripper 41 at the second end of each leg for preventing the tab holder 3 from slipping off the hanger. In the illustrated embodiment, the gripper 41 comprises a longitudinal rib which extends inwardly from the inner surface 17 so that it is able to grip and hold the tab holder 3.

Preferably, the legs 11, 13 taper inwardly from the bridge 15 in order to enable the information tab 1 to be more strongly secured to the tab holder 3. In order to render this feature even more efficient, the information tab 1 may be made of a resilient moulded material or any suitable material, preferably PVC or polystyrene.

Still shown in FIGS. 2 to 4, the information tab 1 may further comprise an integrally formed set of grooves 51 projecting outwardly from the inner surface 17 of the bridge 15. The groove 51 is designed to fit a corresponding extremity of the tab holder 3.

The information tab 1 is shaped to accommodate practically any existing tab holder 3. Indeed FIGS. 2 to 4 show different types of existing tab holders while the sizer of the present invention is placed.

As can be seen more precisely in FIG. 2, the information tab of the present invention is able to receive and be secured on a pear-shaped prior art tab holder. The tab holder comprises an upper and a lower portions. The information tab is designed to receive and guide an extremity of the upper portion through the set of grooves 51 located in the inner surface 17 of the bridge 15. The protruding flanges 31 located in the inner surface of the legs 11, 13 are adapted to grip the area of the tab holder separating the upper portion from the lower portion. The flanges 17 play a crucial role in that by gripping the area between the upper and lower portions, it prevents the information tab to slip out from the tab holder. This is possible since most of the existing (prior art) tab holder are fashioned in such a way as to have an upper and bottom portions that are separated by a thinner "middle" area. Therefor, the upper and lower portions work as a blocking means. The grippers 41 located on the second end of each leg is designed to grip a corresponding end of the lower portion.

Turning now to FIG. 3, the prior art tab holder has a shape of an arrow. The arrow comprises a point portion which is slid in the guides 51 provided in the inner surface 17 of the bridge 15. The arrow further comprises a shaft portion. The flanges 31 of the information tab is designed to grip the arrow at the junction where the point is connected to the shaft. In the illustrated embodiment, the prior art tab holder comprises a thin portion at the end of the shaft. The grippers 41 are adapted to grip the thin portion of the arrow thereby temporarily locking the information tab on the tab holder.

In FIG. 4, the tab holder has the general shape of a double arrow. The two points being separated by a shaft portion. As seen in FIG. 3, the point of the upper arrow is secured in the guides 51 provided in the inner surface 17 of the bridge 15. The flanges 31 and the grippers 41 of the information tab are designed to grip the tab holder through corresponding shaft portions.

As can be seen, the information tab of the invention is advantageously designed to fit any existing tab holder. Furthermore it is also advantageously designed to be removable so that it may be easily reused on another hanger when the first is disposed of.

Figure 5:
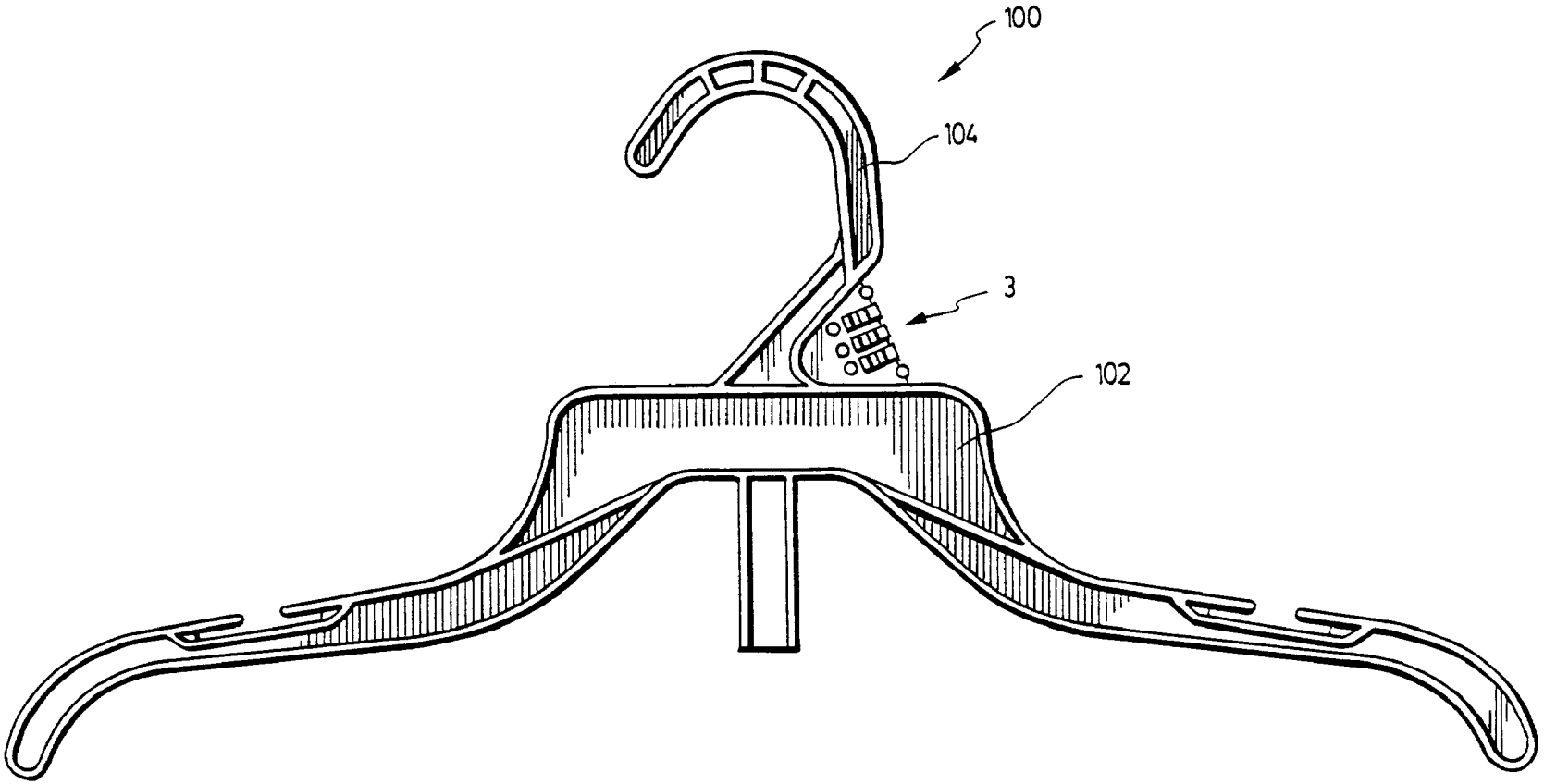
FIG. 5 is a side view of the garment hanger according to a preferred embodiment of the present invention.
Figure 8:
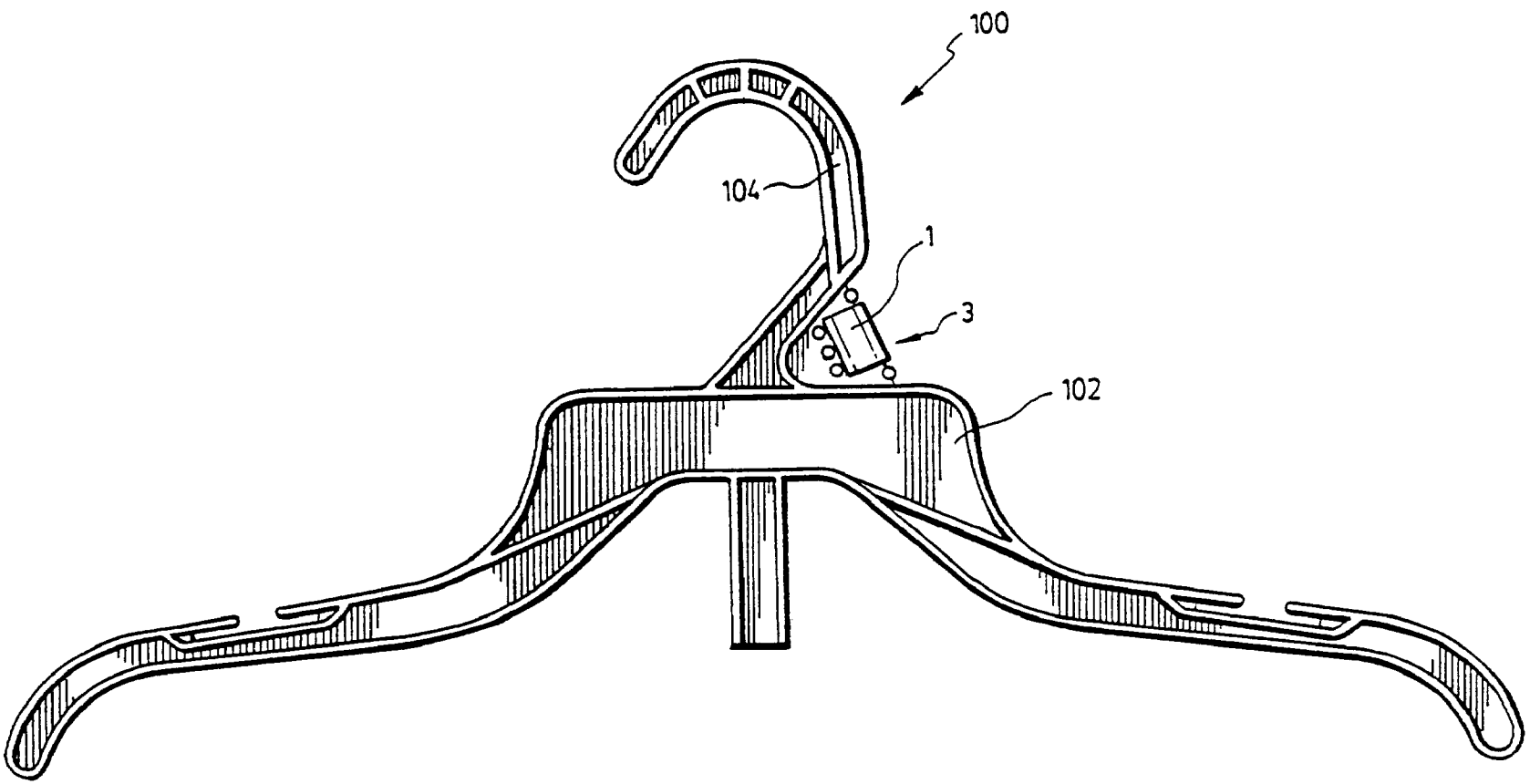
FIG. 8 is a side view of the garment hanger shown in FIG. 5 with an information tab mounted thereon.

According to another aspect of the present invention and as shown in FIG. 5, a garment hanger 100 which is adapted to receive a removable information tab 1 is also provided. The present invention further provides a garment hanger 100 which include an information tab 1 removably secured thereon as shown in FIG. 8. The information tab 1 that is used in accordance with the present invention is preferably a tab like the one described therein. As used herein, the term "removably secured" refers to a tab which cannot be removed by a young child and cannot easily be removed by an adult without the use of a tool. This is especially an important feature since it prevents, for instance, ingestion of the tab by a child. Moreover, the garment hanger of the present invention also offer the advantage of preventing inadvertent removing of the tab, therefore avoiding mislabelling of garments in a store.

Now turning back to FIG. 5, the garment hanger 100 of the present invention comprises a body 102, a hook member 104 connected to the body 102 and a tab holder 3 operatively connected to the hanger 100. It will be understood that the term "garment hanger" used herein refers to hangers for clothing as well for non-clothing items. The hanger of the present invention can be provided with any shapes and made with any suitable materials known to one skilled in the art. Furthermore, the hanger of the invention is produced by using conventional techniques, such as injection molding. It will be also understood that the hook member can take any shape and made with any suitable materials.

Figure 6:
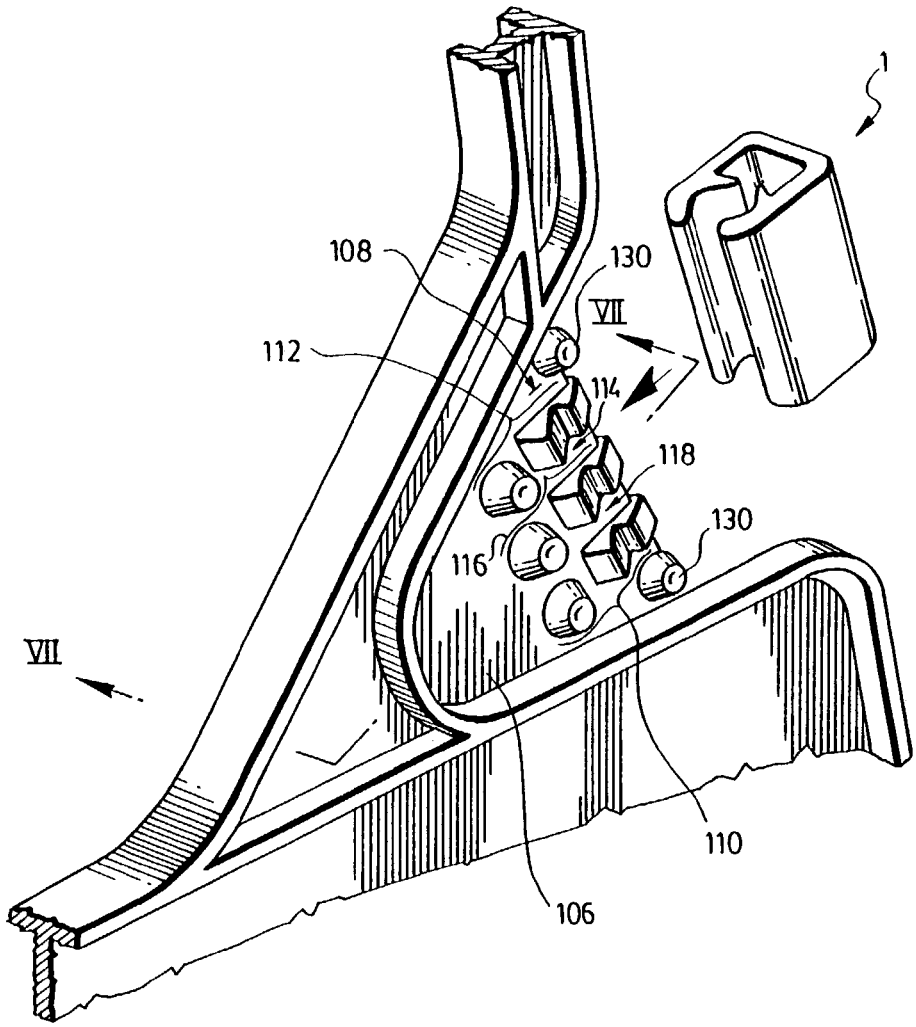
FIG. 6 is an enlarged perspective view of a portion of the garment hanger shown in FIG. 5, illustrating a tab holder according to a preferred embodiment of the invention.
Figure 9:
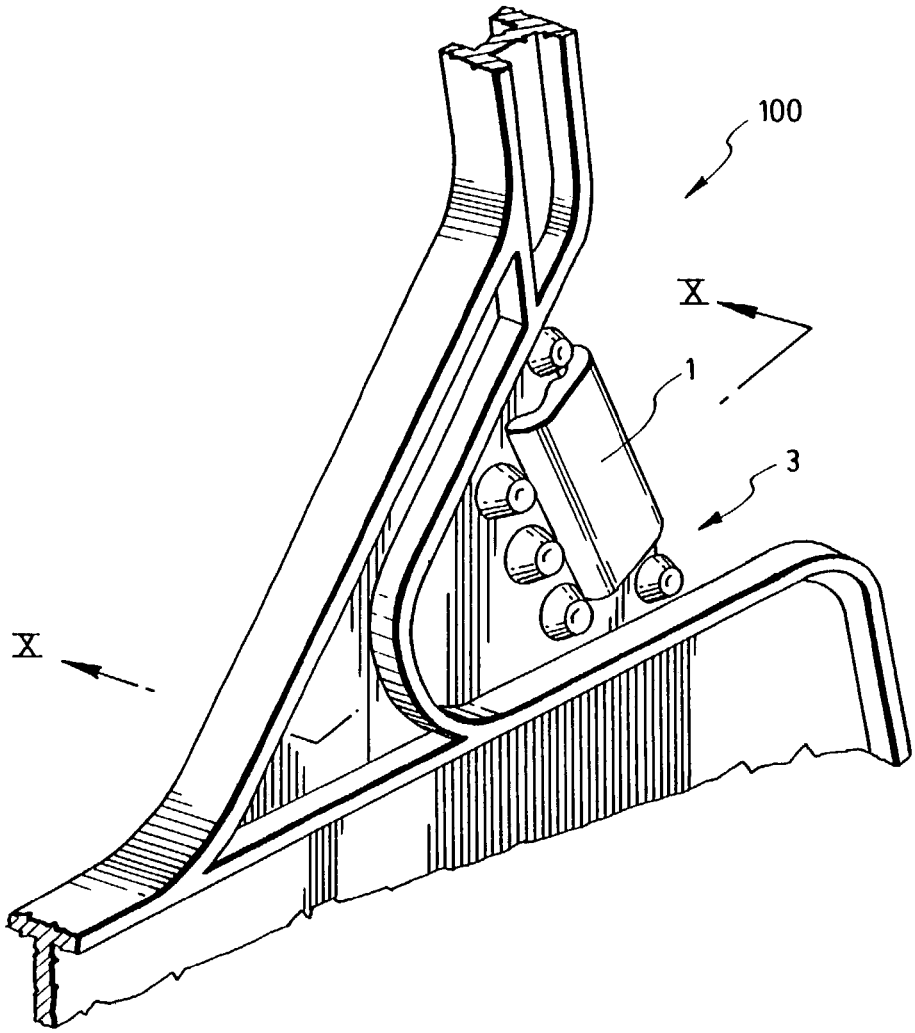
FIG. 9 is an enlarged perspective view of a portion of the garment hanger shown in FIG. 8, which better illustrates the tab securely mounted onto the tab holder.

As mentioned above, the tab holder 3 is operatively connected to the hanger 100. Preferably, the tab holder 3 interconnects the hook member 104 and a portion of the body 102 of the hanger 100 as shown in FIG. 6. Although this is a preferred configuration contemplated by the present invention, the tab holder may be connected to other portion of the hanger as long as it fulfils its role which is to removably secured thereon an information tab, as best seen in FIG. 9. Advantageously, the tab holder 3 is made integral to the hanger 100.

The tab holder 3 comprises two opposites surfaces 106 (only one is shown in the figures). As shown in FIG. 6, each surface 106 has an edge 108, first 110 and second 112 engagement elements that are substantially parallel to one another and disposed substantially perpendicular to the edge 108. Furthermore, the engagements elements are shaped and sized to cooperatively engage with an information tab. Each surfaces also have a first groove 114 that is defined between the first 110 and second 112 engagement elements. Such a groove is particularly an important feature of the invention since it allows a user to easily remove the tab from the tab holder with the aid of a tool. According to a preferred embodiment, each of the surfaces 106 further comprises a third engagement element 116 disposed between the first 110 and second 112 engagement elements. This preferable addition thus defines a second groove 118 that is substantially parallel to the first groove 114. As it can be appreciated, the presence of a third engagement element allows the information tab to be better secured onto the tab holder.

Figure 7:
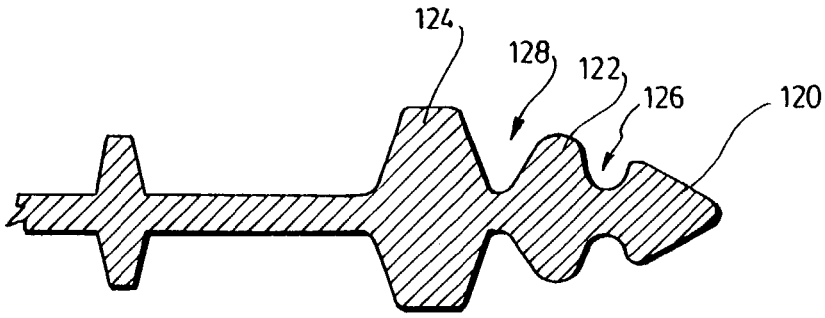
FIG. 7 is a cross sectional view of the tab holder of FIG. 6.

As best understood by viewing FIG. 6 in conjunction with FIG. 7, the engagement elements preferably comprise first 120, second 122 and third 124 projecting members. Preferably, first 120 and second 122 projecting members have a substantially triangular cross-section whereas the third projecting element 126 has preferably a rounded conical cross-section. It will be understood that the first projecting member 120 is the one adjacent to the edge 108 of the opposite surface 106. Furthermore, the engagement elements also comprise a first valley 126 defined between the first 120 and second 122 projecting elements and a second valley 128 defined between the second 122 and third 126 projecting elements. As it will be explained herein below, the valley 126 plays a role in the engagement with portions of the information tab.

FIG. 6 also shows that each of the surfaces 106 preferably comprises two pegs 130 being disposed on either side of the engagement elements 110,112 and substantially along the edge 108 of each of the opposite surfaces 106. These pegs further help in preventing inadvertent removing of the information tab.

Figure 10:
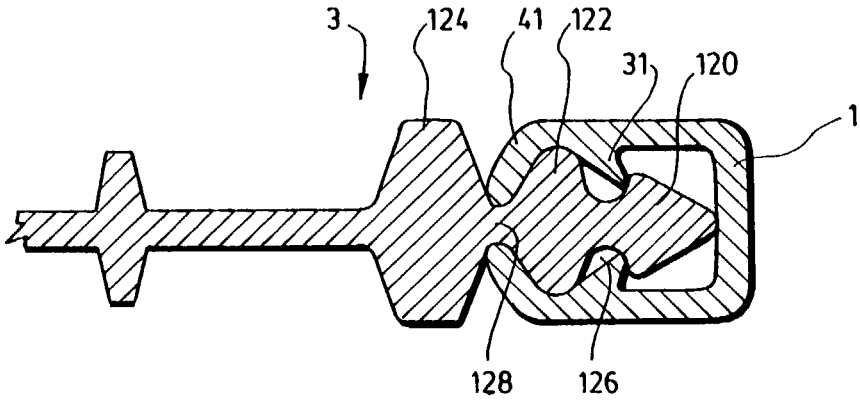
FIG. 10 is a cross sectional view of the tab holder of FIG. 9.

As mentioned previously, FIG. 8 shows the garment 100 of the present invention with an information tab 1 mounted thereon. In order to provide such a garment hanger, a user has to mount usually by sliding or threading a tab unto the tab holder. As best viewed in FIG. 10, the flanges 31 and the grippers 41 of the tab 1 cooperatively engage the first valley 126 and the second projecting element 122 of the tab holder 3, respectively.

As one skilled in the art will appreciate, the second and third projecting members play a beneficial role respectively in the mounting and securing of the tab unto the tab holder. Indeed, the second projecting member allows to force the tab to open, thus permitting the flanges to efficiently engage with the first valley of the tab holder. Preferably, in order to better open the tab, the second projecting member has a height greater than the one of the first projecting member. With respect to the third projecting element, it will be understood that because of its shape and size, the third projecting element makes it difficult to finger pry the tab of the tab holder. Thus, the third projecting member is an important part of the tab holder that participates in the making of a "childproof" hanger.

Although the present invention has been explained hereinabove by way of a preferred embodiment thereof, it should be pointed out that any modifications to this preferred embodiment within the scope of the present description is not deemed to alter or change the nature and scope of the invention.

What is claimed is:

1. A garment hanger adapted to receive a removable information tab, said garment hanger comprising:

a body;

a hook member connected to said body; and a tab holder operatively connected to said hanger, said tab holder comprising two opposite surfaces, each of said opposite surfaces having:

an edge;

first and second identical engagement elements, said engagement elements being substantially parallel to one another, each one of said engagement elements having a first end being disposed substantially perpendicular to said edge and a second end open and opposite to said first end, said engagement elements being further shaped and sized to cooperatively engage with an information tab; and a first groove between said first and second engagement elements, wherein said first groove extends from the first end to the second end of each one of said engagement elements, wherein each of said surfaces further comprises a third engagement element disposed between the first and second engagement elements, and thus defining a second groove substantially parallel to said first groove.

2. The garment hanger of claim 1, wherein the tab holder is made integral to said hanger.

3. A garment hanger adapted to receive a removable information tab, said garment hanger comprising:

a body;

a hook member connected to said body; and a tab holder operatively connected to said hanger, said tab holder comprising two opposite surfaces, each of said opposite surfaces having:

an edge;

first and second identical engagement elements, said engagement elements being substantially parallel to one another, each one of said engagement elements having a first end being disposed substantially perpendicular to said edge and a second end open and opposite to said first end, said engagement elements being further shaped and sized to cooperatively engage with an information tab; and a first groove between said first and second engagement elements, wherein said first groove extends from the first end to the second end of each one of said engagement elements, wherein each of said engagement elements comprises:

first, second and third projecting members, said first projecting member being adjacent to the edge of said opposite surface;

a first valley defined between the first and second projecting members, and a second valley defined between the second and third projecting members.

4. A garment hanger adapted to receive a removable information tab, said garment hanger comprising:

a body;

a hook member connected to said body; and a tab holder operatively connected to said hanger, said tab holder comprising two opposite surfaces, each of said opposite surfaces having:

an edge;

first and second engagement elements, said engagement elements being substantially parallel to one another and being disposed substantially perpendicular to said edge, said engagement elements being further shaped and sized to cooperatively engage with an information tab; and a first groove between said first and second engagement elements wherein each of said surface further comprises two pegs being disposed on either side of the engagement elements and substantially along the edge of each of said opposite surfaces.

5. A garment hanger adapted to receive a removable information tab, said garment hanger comprising:

a body;

a hook member connected to said body;

a tab holder operatively connected to said hanger, said tab holder comprising two opposite surfaces, each of said opposite surfaces having:

an edge;

first, second and third engagement elements, said engagement elements being substantially parallel to one another and being disposed substantially perpendicular to said edge, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein said first and second projecting members of each of said engagement elements have a substantially triangular cross-section.

6. A garment hanger adapted to receive a removable information tab, said garment hanger comprising:

a body;

a hook member connected to said body;

a tab holder operatively connected to said hanger, said tab holder comprising two opposite surfaces, each of said opposite surfaces having:

an edge;

first, second and third identical engagement elements, said engagement elements being substantially parallel to one another, each one of said engagement elements having a first end being disposed substantially perpendicular to said edge, and a second end open and opposite to said first end, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein said first groove and second groove extend from the first end to the second end of each one of said engagement elements.

7. The garment hanger of claim 6, wherein the tab holder is made integral to said hanger.

8. A garment hanger adapted to receive a removable information tab, said garment hanger comprising:

a body;

a hook member connected to said body;

a tab holder operatively connected to said hanger, said tab holder comprising two opposite surfaces, each of said opposite surfaces having:

an edge;

first, second and third engagement elements, said engagement elements being substantially parallel to one another and being disposed substantially perpendicular to said edge, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein each of said surfaces further comprises two pegs being disposed on either side of the first and second engagement elements and substantially along the edge of each of said opposite surfaces.

9. A garment hanger adapted to receive a removable information tab, said garment hanger comprising:

a body;

a hook member connected to said body;

a tab holder operatively connected to said hanger, said tab holder comprising two opposite surfaces, each of said opposite surfaces having:

an edge;

first, second and third engagement elements, said engagement elements being substantially parallel to one another and being disposed substantially perpendicular to said edge, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein said first and second members of each of said engagement elements have a substantially triangular cross-section.

10. A garment hanger comprising:

a body;

a hook member connected to said body;

a tab holder operatively connected to said hanger; and a removable information tab cooperatively engaging said tab holder, said tab holder comprising two opposites surfaces, each of said opposite surfaces having:

an edge;

first, second and third identical engagement elements, said engagement elements being substantially parallel to one another, each one of said engagement elements having a first end being disposed substantially perpendicular to said edge and a second end open and opposite to said first end, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein said first groove and second groove extend from the first end to the second end of each one of said engagement elements.

11. The garment hanger of claim 10, wherein said information tab comprises a U-shaped bracket including two legs extending generally parallel to each other, the two legs each having a first and second end, the first end being connected to a bridge, the bridge forming a closed end of the bracket, said U-shaped bracket defining an inner surface adapted to be removably secured on the tab holder of the garment hanger, each of said leg comprising at the inner surface:

an integrally formed flange for cooperatively engaging with said first valley of the tab holder, said flange projecting perpendicularly inwardly from the inner surface of the bracket, the flange being formed at a distance D1 from the first end of the leg each of the flanges having an end, the width between each end being W1, and an integrally formed gripper at the second end of each leg adapted to engage with the second valley of the tab holder for preventing the information tab from slipping off the hanger.

12. The garment hanger of claim 10, wherein the tab holder is made integral to said hanger.

13. A garment hanger comprising:

a body;

a hook member connected to said body;

a tab holder operatively connected to said hanger; and a removable information tab cooperatively engaging said tab holder, said tab holder comprising two opposite surfaces, each of said opposite surfaces having:

an edge;

first, second and third engagement elements, said engagement elements being substantially parallel to one another and being disposed substantially perpendicular to said edge, each of said engagement elements comprising:

first, second and third projecting members, said first projecting member being adjacent to the edge of said opposite surface;

a first valley defined between the first and second projecting members;

a second valley defined between the second and third projecting members;

a first groove being defined between said first and third engagement elements; and a second groove being defined between said second and third engagement elements, wherein each of said opposite surfaces further comprises two pegs being disposed on either side of the first and second engagement elements and substantially along the edge of each of said opposite surfaces.

14. A garment hanger comprising:

a body;

a hook member connected to said body;

a tab holder operatively connected to said hanger; and a removable information tab cooperatively engaging said tab holder, said tab holder comprising two opposite surfaces, each of said opposite surfaces having:

an edge;

first, second and third engagement elements, said engagement elements being substantially parallel to one another and being disposed substantially perpendicular to said edge, each of said engagement elements comprising:

first, second and third projecting members, said first projecting member being adjacent to the edge of said opposite surface;

a first valley defined between the first and second projecting members; and a second valley defined between the second and third projecting members;

a first groove being defined between said first and third engagement elements; and a second groove being defined between said second and third engagement elements, wherein said first and second members of each of said engagement elements have a substantially triangular cross-section.

* * * * *